US007980561B2

(12) United States Patent
Byram et al.

(10) Patent No.: US 7,980,561 B2
(45) Date of Patent: Jul. 19, 2011

(54) PAINTBALL TARGETING SYSTEM

(76) Inventors: George Byram, Westfield, MA (US); Brad Garvey, Westfield, MA (US)

( * ) Notice: Subject to any disclaimer, the term of this patent is extended or adjusted under 35 U.S.C. 154(b) by 0 days.

(21) Appl. No.: 11/748,260

(22) Filed: May 14, 2007

(65) Prior Publication Data

US 2008/0023154 A1 Jan. 31, 2008

Related U.S. Application Data

(62) Division of application No. 11/298,917, filed on Dec. 9, 2005, now Pat. No. 7,494,128.

(51) Int. Cl.
*F41J 13/00* (2009.01)

(52) U.S. Cl. ..... 273/410; 273/407; 473/195

(58) Field of Classification Search ..... 273/398–409, 273/348, 355; 473/197
See application file for complete search history.

(56) References Cited

U.S. PATENT DOCUMENTS

| | | | | | |
|---|---|---|---|---|---|
| 1,166,496 | A | * | 1/1916 | Torrey | 473/173 |
| 1,677,442 | A | | 7/1928 | Hall | 473/190 |
| 2,397,921 | A | * | 4/1946 | Cole | 273/410 |
| 2,899,208 | A | | 8/1959 | Wallsteiner | 473/194 |
| 3,122,367 | A | | 2/1964 | Dale | |
| 3,802,703 | A | * | 4/1974 | Van Tassel | 273/402 |
| 4,066,262 | A | * | 1/1978 | Stiefel | 273/400 |
| 4,538,814 | A | * | 9/1985 | Cunningham | 473/163 |
| 4,556,219 | A | | 12/1985 | Tillery | 473/197 |
| 4,583,744 | A | * | 4/1986 | Tolliver et al. | 273/404 |
| 5,046,720 | A | | 9/1991 | Bolly | 472/62 |
| 5,219,316 | A | | 6/1993 | Huffman | 472/62 |
| 5,431,410 | A | * | 7/1995 | Hampton | 273/397 |
| 6,223,658 | B1 | | 5/2001 | Rosa et al. | 102/501 |
| 6,305,367 | B1 | | 10/2001 | Kotsiopoulos et al. | 124/49 |
| 6,453,593 | B1 | | 9/2002 | Dillon et al. | 42/76.01 |
| 6,467,473 | B1 | | 10/2002 | Kostiopoulos | 124/51.1 |
| 6,488,019 | B2 | | 12/2002 | Kotsiopoulos | 124/51.1 |
| 6,532,947 | B1 | | 3/2003 | Rosa et al. | 124/56 |
| 6,857,460 | B1 | | 2/2005 | Mowry | 160/351 |
| 6,966,852 | B2 | | 11/2005 | Yoon | 473/421 |
| 7,434,811 | B1 | | 10/2008 | Coburn et al. | |
| 7,494,128 | B2 | | 2/2009 | Byram et al. | |
| 2003/0125121 | A1 | | 7/2003 | Rhee | 473/195 |
| 2005/0242507 | A1 | | 11/2005 | Patterson et al. | 273/348 |
| 2007/0035528 | A1 | | 2/2007 | Hodge | 345/174 |

OTHER PUBLICATIONS

Prior Art Search dated May 6, 2005 (11 pgs.).
888paintball.com. (Oct. 28, 2004), [online] Retrieved from the Internet: <URL:http://www.888paintball.com> [retrieved on Jul. 11, 2008].
History of Paintball. (Oct. 25, 2005), [online] Retrieved from the Internet: <URL:http://www.gorillapaintball.com/history.html> [retrieved on Jul. 7, 2008].
Little, J.R. and Wong, C.F., "Ultimate Guide to Paintball". Chicago, IL: Contemporary Books (2001).

(Continued)

*Primary Examiner* — Mark S Graham
(74) *Attorney, Agent, or Firm* — Fish & Richardson P.C.

(57) ABSTRACT

A paintball target holder includes a frame having plural parts that are movable relative to one another in order to fold the frame and thereby reduce a volume encompassed by the frame. The plural parts include a front part, a back part, and a bottom part. The paintball target holder includes a target mounted to the front part, layers of material mounted between the target and the back part, where the layers of material receive a paintball through the target, and a paintball loader mounted to the bottom part. The paintball loader receives the paintball from the layers of material via the bottom part.

20 Claims, 9 Drawing Sheets

OTHER PUBLICATIONS

Paintball Participation Trends Up In 2002. (Feb. 23, 2005) [online] Retrieved from the Internet: <URL:http://apg.cfw2.com/article.asp?content_id=3175> [retrieved on Jul. 11, 2008].

Paintball Statistics. (Feb. 27, 2005) [online] Retrieved from the Internet: <URL:http://www.paint-ball.org/paintball/statistics.htm> [retrieved on Jul. 7, 2008].

Physics of Paintball. (Mar. 1, 2005), [online] Retrieved from the Internet: <URL:http://home.comcast.net/~dyryemn/pball/paintball.html> [retrieved on Jul. 7, 2008].

Stuff—Matt's Pro/Carbine Page (Mar. 1, 2005), [online] Retrieved from the Internet: <URL:http://procarbine.cjb.net/> [retrieved on Jul. 7, 2008].

T-Ball Target; target system. (Mar. 1, 2005), [online] Retrieved from the Internet: <URL:http://rufusdawg.com/Merchant2/merchant.mvc?Screen=PROD&Store_Code=RD&Product_Code=TBTtarget-system&Category_Code=TBT> [retrieved on Jul. 7, 2008].

The History of Paintball Games. (Feb. 28, 2005), [online] Retrieved from the Internet: <URL:http://paintball.about.com/od/gametypes/a/gamehistory.htm> [retrieved on Jul. 7, 2008].

Tippmann Custom 98 Electronic Kit Pneumatic (E-Bolt). (Nov. 1, 2004), [online] Retrieved from the Intemet:<URL:<http://www.hotshotpaintball.com> [retrieved on Jul. 7, 2008].

Tippmann Pneumatics LLC. (Oct. 28, 2004), [online] Retrieved from the Internet: <URL:http://www.tippmann.com> [retrieved on Jun. 7, 2008].

Vballs Target System. (Mar. 1, 2005), [online] Retrieved from the Internet:<URL:http://www.vballs.com/default.html> [retrieved on Jul. 7, 2008].

Action and Response History retrieved from PAIR from U.S. Appl. No. 11/298,917, through Jul. 11, 2008.

Product Information—Savage Range Systems [online] Retrieved from the Internet<URL: http://snailtraps.com/pdfs/SavageRangeSystemsBrochure.pdf> [retrieved on Jan. 12, 2009].

Snailtraps.com website information [online] Retrieved from the Internet<URL:http://www.snailtraps.com> [retrieved on Jan. 12, 2009].

Product Information for Colt Electronic Airsoft Mesh Trap Target, [online] Retrieved from the Internet: <URL:http://www.paintball-online.com/paintball/product_information.asp?number=ASTCET> [retrieved on Aug. 14, 2008].

Product Information for RADARchron, [online] Retrieved from the Internet<URL:http://www.paintball-online.com/paintball/Paintball-RADARchron_prod_FSCHNRD> [retrieved on Aug. 14, 2008].

Product Information for RADARchron, [online] Retrieved from the Internet<URL:http://www.paintballradar.com/> [retrieved on Aug. 14, 2008].

Screen shot of Discountpaintball.com [online], Retrieved from the Internet<URL:http://www.discountpaintball.com> [retrieved on Aug. 14, 2008].

RPS-Paintball.com—product listing, [online] Retrieved from the Internet<URL:http://www.rps-paintball.com/matrix.asp#> [retrieved on Aug. 14, 2008].

Product Information for Viewloader Heavy Metal Paintballs, [online] Retrieved from the Internet<URL:http://www.paintballkit.com/products/viewloader/heavy_metal_paintballs.cfm> [retrieved on Aug. 14, 2008].

Product Information for Do-all Traps Auto Reset Pball Target, [online] Retrieved from the Internet<URL:http://www.dowdlesports.com/catalog/guns/trapskeet.htm#targets> [retrieved on Aug. 14, 2008].

Product Information for Grippers Target System, [online] Retrieved from the Internet:<URL:http://www.buy.com/prod/grippers-target-system/q/loc/17250/205690517.html> [retrieved on Aug. 14, 2008].

* cited by examiner

PAINTBALL TARGETING SYSTEM

CROSS-REFERENCE TO RELATED APPLICATION

This application is a divisional (and claims the benefit of priority under 35 USC 120) of U.S. application Ser. No. 11/298,917, filed Dec. 9, 2005 now U.S. Pat. No. 7,494,128. The disclosure of the prior application is considered part of (and is incorporated by reference in) the disclosure of this application as if set forth herein in full.

TECHNICAL FIELD

This patent application relates generally to a paintball targeting system that is capable of preserving paintballs during target practice.

BACKGROUND

Paintball is a sport in which players fire projectiles, known as paintballs, at each other. Paintballs typically have a glycerin shell and a gelatin interior. The shell breaks upon impact, which releases the gelatin interior without considerable harm to the player. The gelatin interior leaves a colored mark, which indicates that the player has been hit.

As with any sport, practice increases a player's skill. The cost of paintballs, however, can make target practice expensive. That is, since paintballs typically break upon impact, each practice shot requires a new paintball. With paintballs running at $15 per container at the low end, the cost of target practice can add up quickly.

Systems were therefore developed specifically for paintball target practice. These systems do not use actual paintballs, but rather use simulated paintballs, which are solid and which therefore do not break upon impact. Solid balls, however, do not "fly" the same way that real paintballs do and, thus, are not an accurate predictor as to how a real paintball will behave under similar circumstances (e.g., distance to target and weather conditions, such as wind, rain, etc.). Existing paintball target practice systems are therefore not always helpful when is comes to increasing player's aim.

Existing paintball target practice systems have other drawbacks as well. For example, the projectiles used in such system can be a safety hazard. That is, the projectiles are relatively hard and can cause injury. Also, existing paintball target practice systems are relatively expensive, making target practice difficult for some.

SUMMARY

This patent application describes methods and apparatus for preserving paintballs during target practice.

In general, in one aspect, the invention is directed to an apparatus that includes a frame comprising a front part for mounting a target and layers of material attached to the frame behind the front part. This aspect may also include one or more of the following.

The frame may includes sides. The sides may be at an angle relative to front part. The apparatus may include sidewalls attached to the sides. The sidewalls may at least partly enclose the layers of material within the frame. The frame may include a back part. The back part may be behind the layers of material relative to the front part. The apparatus may include a backwall attached to back part. The backwall may at least partly enclose the layers of material within the frame. The backwall and the sidewalls may be parts of a single contiguous structure. The single contiguous structure may include a second material that is formed around at least the sides and back part of the frame.

The frame may include a bottom part. A structure may be attached to the bottom part. The structure may be for directing objects to a specific point relative to the frame. The structure may include a funnel and the objects may be paintballs fired at the apparatus. A mount may be included in the apparatus for accepting a cartridge. The structure may direct the objects into the cartridge. The frame may be foldable. The layers of material may include three or more layers of material. The material may include a mesh. At least one layer of material may include plural separate strips of material.

In general, in another aspect, the invention is directed to a paintball target holder ("the holder") that includes a frame having plural parts that are movable relative to one another in order to fold the frame and thereby reduce a volume encompassed by the frame. The plural parts comprise a front part, a back part, and a bottom part. The holder also includes a target mounted to the front part, layers of material mounted between the target and the back part, where the layers of material are for receiving a paintball through the target, and a paintball loader mounted to the bottom part. The paintball loader is for receiving the paintball via the layers of material.

The foregoing aspect may include one or more of the following features. A structure may be attached to the bottom part and may be configured to direct the paintballs to the paintball loader. The structure may be made of moldable plastic. The holder may include a material stretching from the front part and around the back part to enclose at least part of the layers of material. The holder may include sidewalls that are arranged at an angle relative to the layers of material. The sidewalls may be for restricting sideways motion of the paintballs relative to the layers of material. The layers of material may include at least one layer of mesh material. At least one of the layers of material adjacent to the target may be made of plural strips and at least one of the layers of material adjacent to the back part may be made of a single contiguous piece of material. The layers of material may be capable of absorbing at least 153 pounds from a paintball without breaking the paintball. The holder may also include a device for mounting the target onto the front part. The device may mount the target such that the target is removable from the front part.

In general, in another aspect, the invention is directed to a method of preserving paintballs during target practice. The method includes receiving a paintball in layers of material, where the paintball is received via a target mounted in front of the layers of material, showing forward motion of the paintball via the layers of material without breaking the paintball, where gravity causes the paintball to fall downward during motion of the paintball through the layers of material, receiving the paintball from the layers of material without breaking the paintball or causing substantial damage thereto, and directing the paintball to a paintball loader. The layers of material may be capable of absorbing at least 153 pounds from a paintball without breaking the paintball.

The details of one or more examples are set forth in the accompanying drawings and the description below. Further features, aspects, and advantages of the invention will become apparent from the description, the drawings, and the claims.

DESCRIPTION OF THE DRAWINGS

Like reference numerals in different figures indicate like elements.

DETAILED DESCRIPTION

Figure 1:
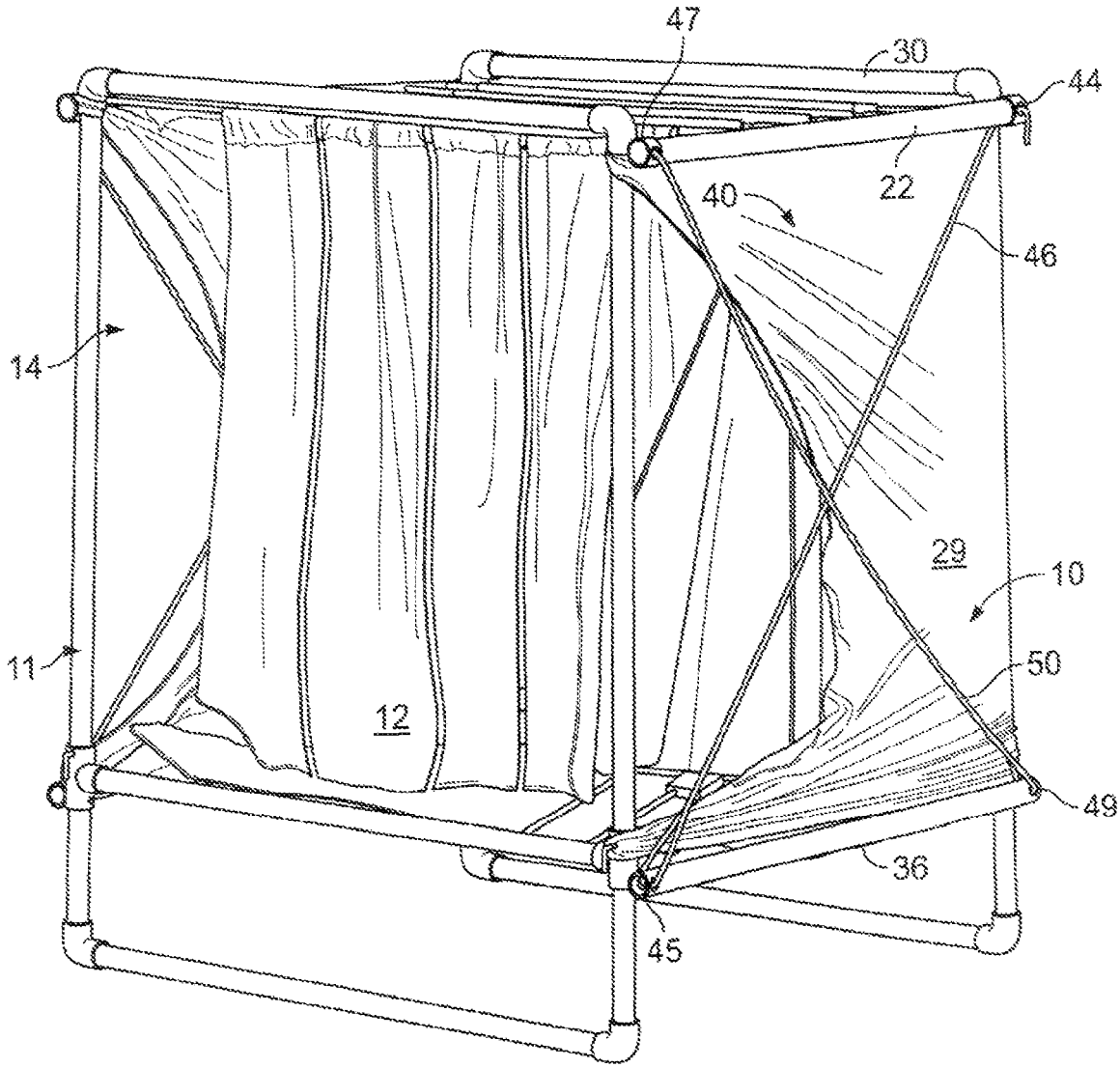
FIG. 1 is a front perspective view of a paintball targeting system.

FIG. 1 is a perspective view of a paintball targeting system. In this example, the paintball targeting system is implemented via device 10, which holds a paintball target. Device 10 includes a frame 11, a target mount (not shown), and layers 12 of material. Frame 11 may be constructed from a relatively sturdy material, such as PVC (polyvinyl chloride) or other type of plastic, metal, wood, or the like. For the purposes of this description, frame 11 will be considered to include front, back, top and bottom parts.

Figure 2:
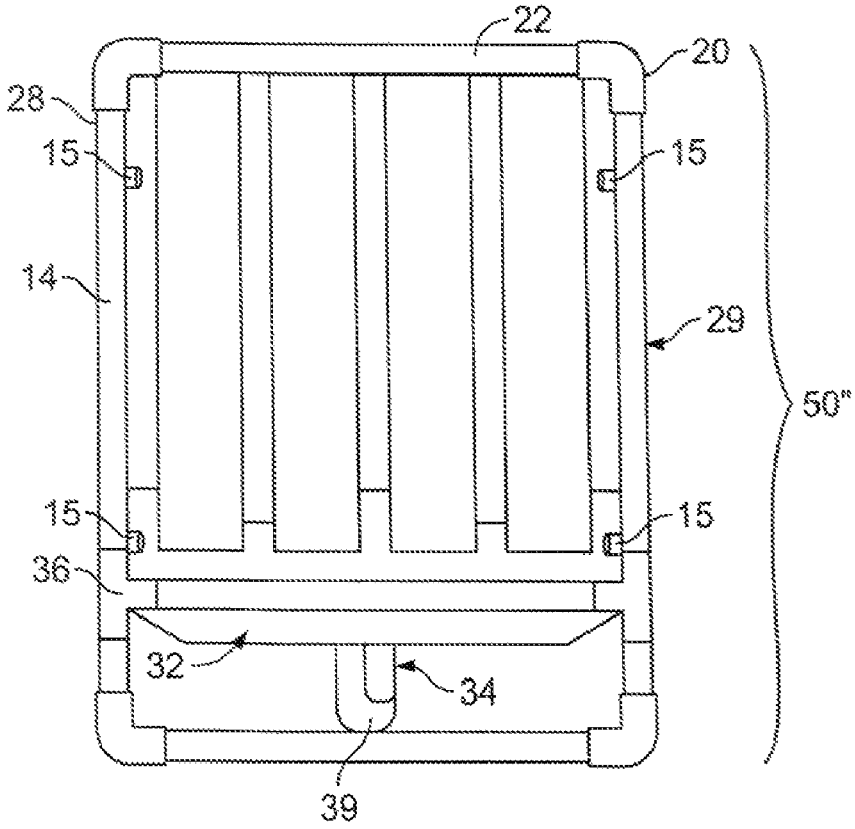
FIG. 2 is a front view of the paintball targeting system.
Figure 3:
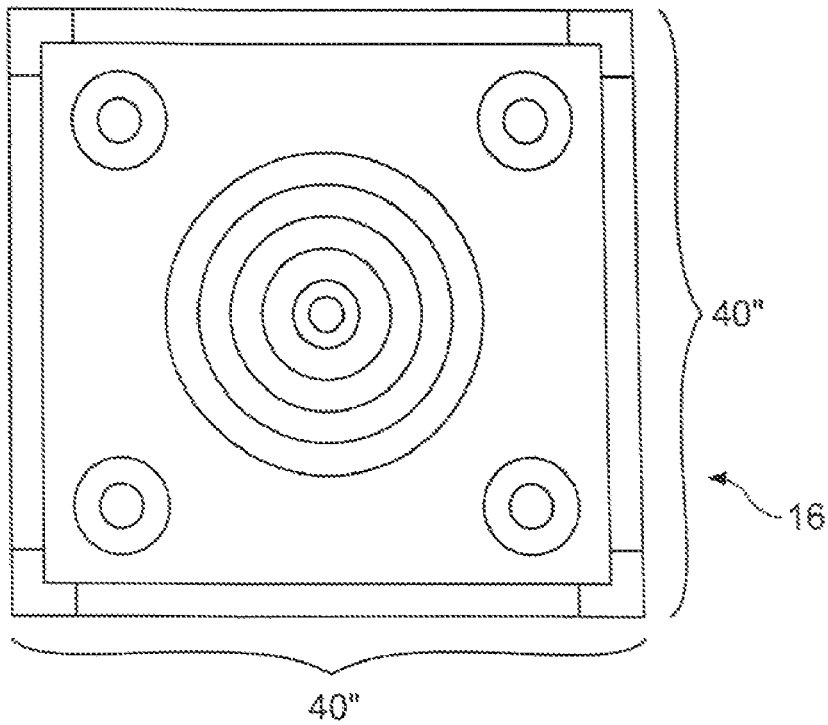
FIG. 3 is a front view of a target for the paintball targeting system.

Referring also to FIG. 2, front part 14 faces the paintball player during target practice. Front part 14 includes a target mount 15 for holding a target, such as target 16 (FIG. 3). The target may be made of paper, such as tracing paper or blueprint paper, which is then enough to permit a standard paintball to pass through without breaking. In this regard, a standard paintball, such as the paintballs produced by RPS Paintball (www. RPS-paintball.com circa October 2005), can withstand about 153 pounds (lbs) of force without breaking (i.e., approximately 153 pounds of force is imparted to the paintball when the paintball is fired from a gun). Target 16 should permit penetration at less than or equal to 153 pounds of force without breaking the paintball. Of course, the structure and/or material of target 16 may be modified for use with paintballs that are capable of withstanding more or less than 153 pounds of force without breaking.

In this implementation, target mount 15 includes Velcro® or other similar material, to which target 16 may be adhered and then removed relatively easily (e.g., in order to replace it with a new target). Both target mount 15 and target 16 may contain Velcro® which, when mated, holds target 16 onto the front part of frame 11. It is noted, however, that device 10 is not limited to using adhesive material to holding target 16. Any suitable mechanism may be used to mount target 16. For example, mechanical devices, such as slots, screws, clamps, pins, etc. may be used to hold target 16 in place.

Figure 4:
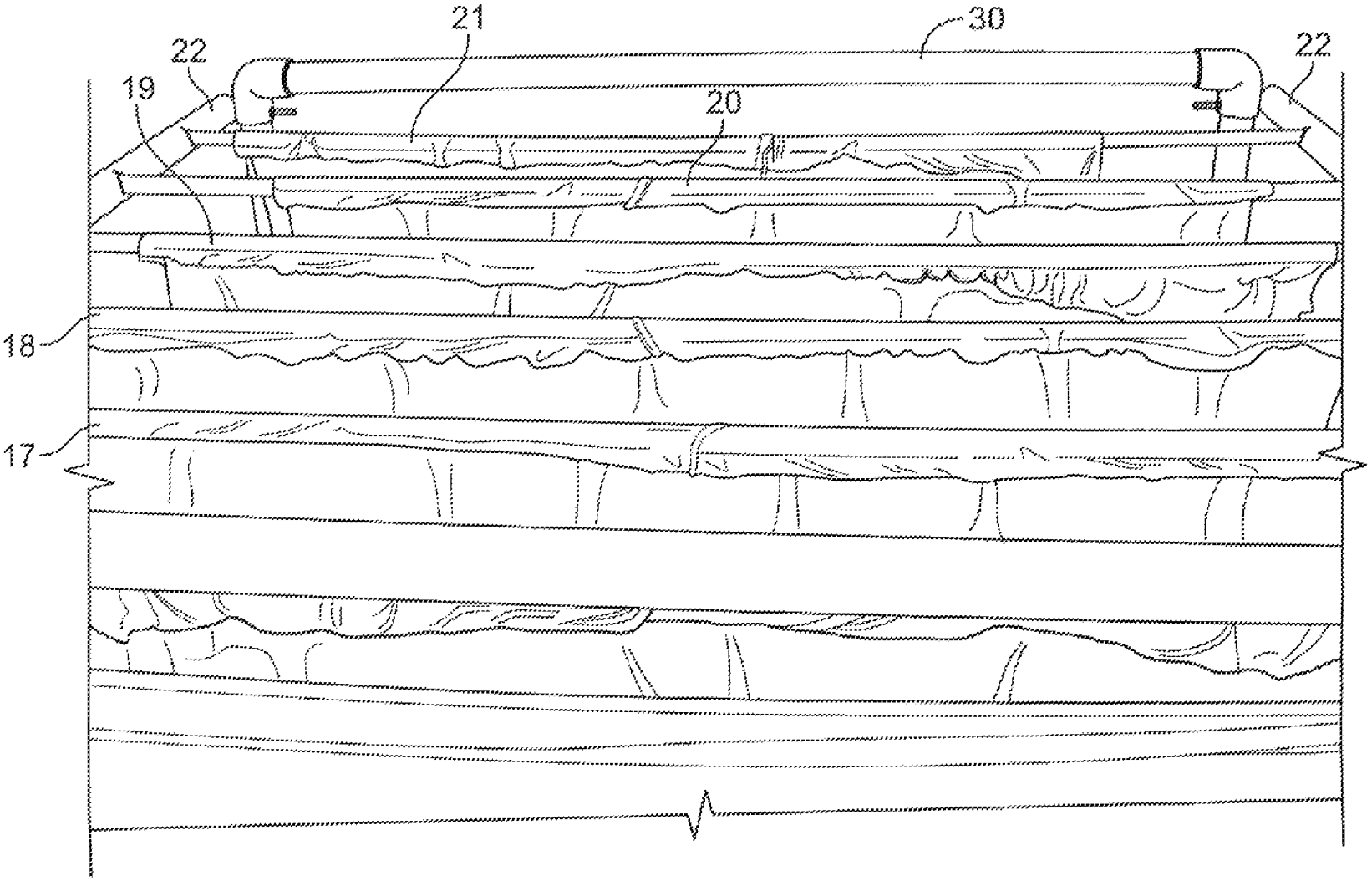
FIG. 4 is a top perspective view of the paintball targeting system.
Figure 5:
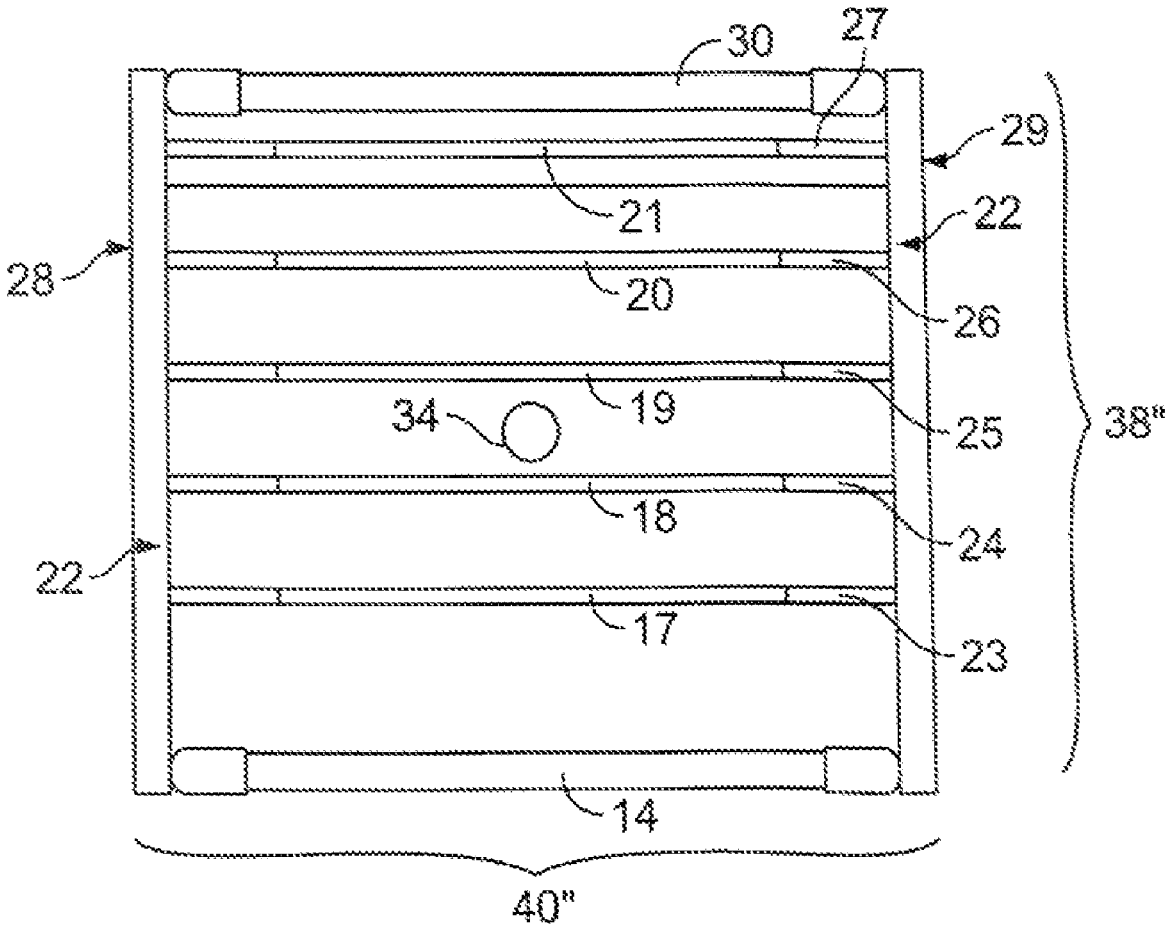
FIG. 5 is a top view of the paintball targeting system.

Device 10 includes various layers of material behind target 16. Referring also to FIGS. 4 and 5, there are five such layers 17 to 21 in this example; however, more or less layers may be incorporated as needed. As shown in FIGS. 4 and 5, layers 17 to 21 are mounted to the top part 22 of frame 11. In this implementation, layers 17 to 21 of material are mounted to corresponding rods 23 to 27 between sides 28 and 29; however, device 10 is not limited to this construction. For example, layers 17 to 21 may be mounted to wires or to a planar top or other construct. One or more of layers 17 to 21 may be cut into plural strips, as shown, e.g., in FIG. 2. For example, the first two layers 17 and 18—those closest to front part 14—may be strips. The remaining three layers 19 to 21—those closest to back part 30—may each be a single contiguous piece of material. In other implementations, the locations and numbers of "stripped" layers may be different. For example, all layers may be stripped or none of the layers may be stripped.

As shown in FIG. 4, the material that makes-up layers 17 to 21 may be a relatively light mesh-like cloth, plastic, or other perforated or non-perforated material. For example, the material may be a "Poly DK Solids" polyester material manufactured under the name Golden D' or Fabrics by Murray A. Goldenberg Textiles, Inc. in Farmer's Branch, Tex. (www. goldendor.com circa October 2005). In this example, the combination of layers 17 to 21 should be sufficient to absorb at least 153 pounds of force from a paintball fired at target 16 (however, this number may vary based on the amount of force a particular type of paintball can withstand without braking upon impact). More specifically, as noted above, one type of standard paintball is capable of withstanding about 153 pounds of force without breaking. Therefore, in order to preserve such a paintball fired at target 16, layers 17 to 21, when taken in combination, should be able to absorb at least 153 pounds of force from the impact of a paintball without causing the paintball to break. In other implementations, the type and number of layers of material may be changed to absorb different amount of force.

During target practice, a paintball is fired at device 10. Ideally, the paintball passes through target 16, without breaking, to reach the layers of material. Each layer provides sufficient resistance to slow the paintball's forward motion without breaking the paintball (where forward motion here refers to motion imparted by the paintball gun, e.g., motion substantially parallel to the ground on which device 10 sits). In this implementation, the first two layers 17 and 18 include strips. Strips are used in these initial layers because the velocity of the paintball is still relatively high as it enters device 10. Contiguous layers of material could, in some cases, provide too much resistance at initial impact, resulting in breakage of the paintball. The strips, on the other hand, act to reduce the velocity of the paintball while providing a decreased impact force relative to a single contiguous piece of material. Thus, by the time the paintball reaches layers 19 to 21, its velocity is reduced. As such, the force of impact on layers 19 to 21 should not cause the paintball to break.

Figure 6:
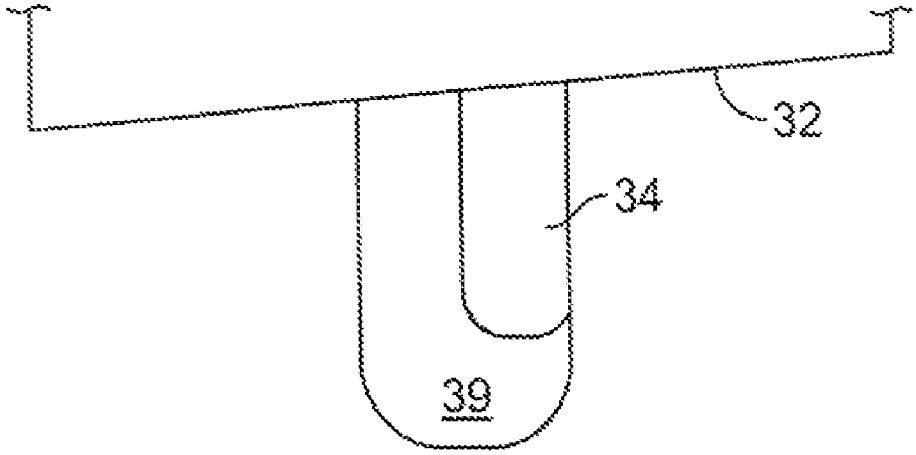
FIGS. 6 and 7 are alternative configurations of a structure used in the paintball targeting system to direct paintballs to a speedloader.
Figure 7:
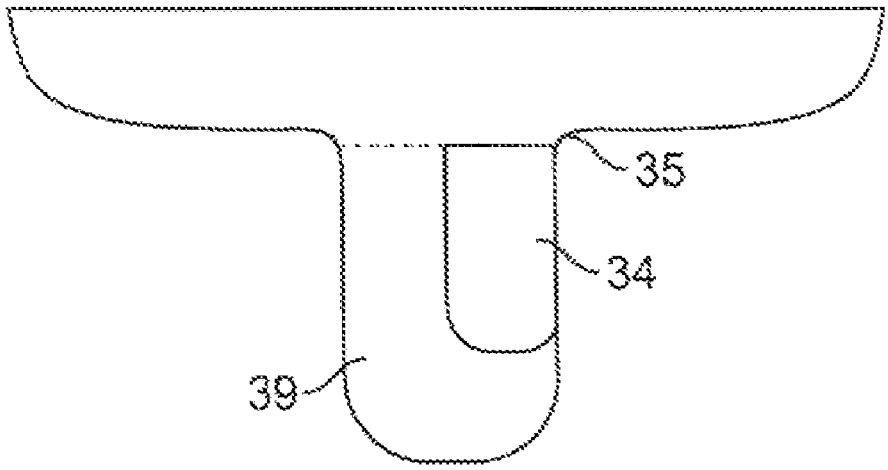

A structure 32 (e.g., a tray) may be mounted to bottom part 36 of frame 11, as shown in FIG. 2. Structure 32 catches (i.e., receives) paintballs from layers 17 to 21 of material. That is, the layers of material slow, and eventually stop, the forward motion of the paintball. Gravity (downward force) causes the paintball to fall into structure 32, where the paintball is received. Structure 32 is shaped to direct a paintball it receives to a particular location relative to frame 11. In this implementation, structure 32 directs the paintball to a cartridge, such as a paintball gun speedloader (described below). To this end, structure 32 may be angled or curved, as shown in FIG. 6, to cause the paintball to roll into speedloader 34. In an experimental implementation, structure 32 was made of folded foam board to produce the necessary angle. In a commercial implementation, structure 32 may be formed of moldable plastic, wood, metal, or any other substantially rigid material. In these implementations, structure 32 may have a funnel-shaped portion for directing paintballs into a speedloader (see, e.g., funnel shaped portion 35 of FIG. 7).

A padding or the other soft material may be applied to a surface of structure 32 that receives the paintballs in order to reduce the likelihood that the paintballs will break upon impact with structure 32. In this implementation, the padding should be sufficiently rigid to allow the structure to direct the paintballs to the cartridge. However, in other implementations, structure 32 may simply receive, and not direct the paintballs to a location. In these implementations, the padding may be as soft as desired.

A typical speedloader is cylindrical in shape and holds 100 to 200 paintballs. Device 10 may be used with such a speedloader or with speedloaders that hold considerably more or considerably less paintballs. The speedloader (also called a "pod"), in this example, is a cartridge that holds paintballs and that is used to transfer paintballs to the hopper of paintball gun, from which the paintballs are loaded into the gun. In this context, a hopper is a storage bin that mounts atop a paintball gun and that typically stores 150 to 200 paintballs prior to being chambered in the gun.

Bottom part 36 of frame 11 includes a mount 39 for holding a speedloader 34 in position such that an open end of the speedloader is positioned to receive paintballs from structure 32. In this example, structure 32 receives paintballs and directs (e.g., funnels) the received paintballs to the open end of speedloader 34. Mount 39 may be a simple mechanical device (e.g., a clamp) and/or Velcro® strips, which is capable of supporting the weight of a fully-loaded speedloader. In this implementation shown in the figures, mount 39 is a sleeve, into which speedloader 34 may be inserted.

In any case, mount 39 is configured such that speedloader 34 can be easily removed when it is full, and such that a full speedloader can be easily replaced with an empty speedloader. Thus, during target practice, a player may fire numerous rounds at target 16, and those rounds that hit device 10 are automatically loaded into speedloader 34. When the player is ready for additional target practice, the player need simply remove the speedloader from mount 39 and install the speedloader in a paintball gun. A new speedloader may (or may not) be installed in mount 39 at this point. In some implementations, device 10 may include two or more mounts for holding additional speedloaders. Typically, only one of these mounts will be positioned to hold a speedloader at a position to receive paintballs from structure 32; however, the invention is not limited as such.

Figure 8:
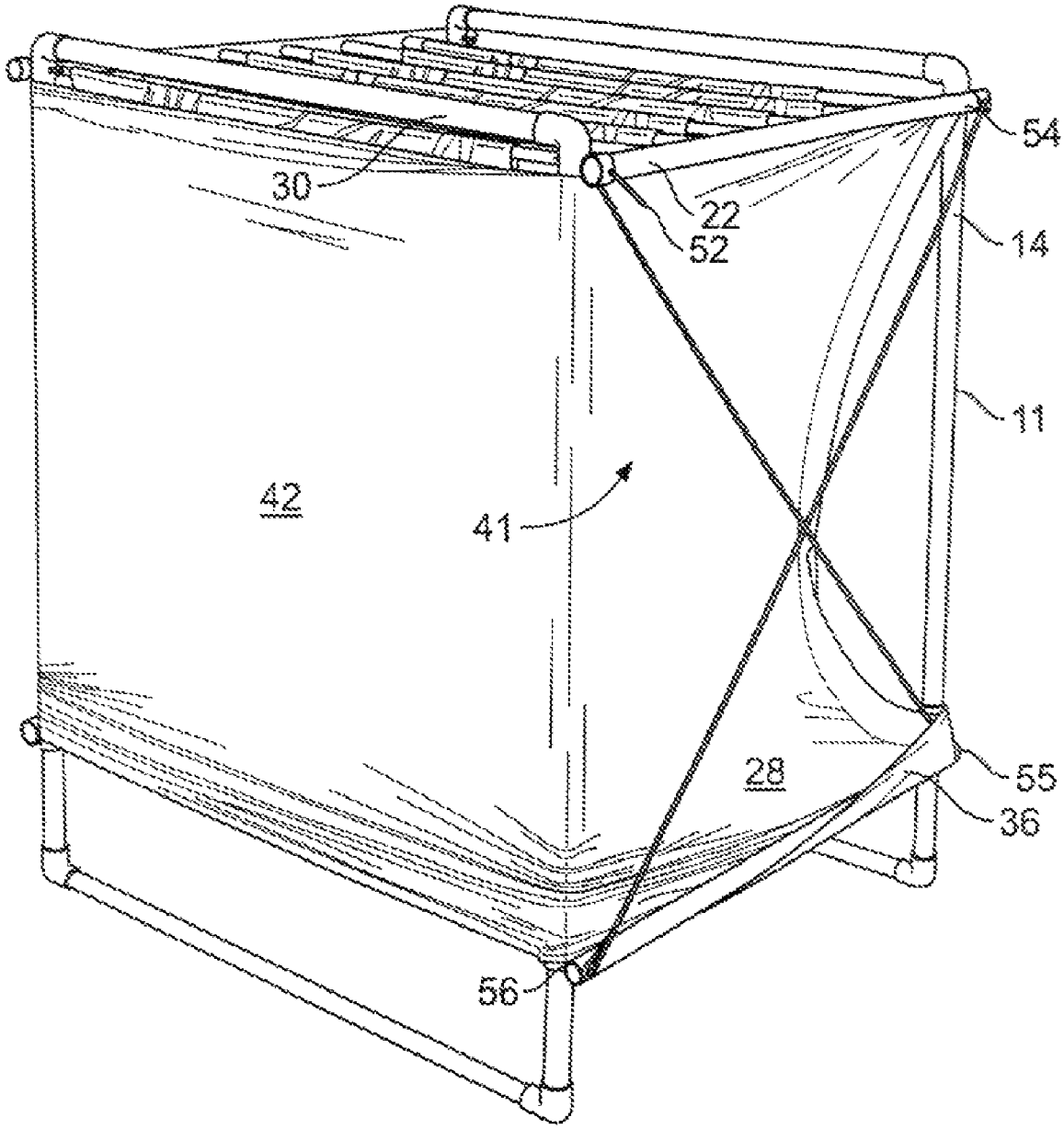
FIG. 8 is a back perspective view of the paintball targeting system.

As shown in FIGS. 1 and 8, device 10 includes sidewalls 40 and 41 on its sides and backwall 42 on back part 30. In this implementation, sidewalls 40 and 41 and backwall 42 are formed from a single contiguous piece of material, such as polyester or tarp, which has a degree of elasticity. Thus, the material stretches over at least part of the sides and the back parts to substantially enclose the layers of material within device 10. The sidewalls and backwall act to prevent paintballs from falling outside of device 10 and, thus, also assist in directing paintballs to structure 32. It is noted that, in the implementation shown in the figures, the sidewalls do not completely cover the sides of device 10. In other implementations, the sidewalls may be configured to completely cover the sides and thereby enclose the layers of material within device 10. Furthermore, in other implementations, the sidewalls and backwall may be separate pieces and may be made of different materials, such as plastic, metal, cloth and/or wood.

In the implementation shown in the figures, the shape of device 10 is maintained, at least partly, via cross-coupled tension devices. Here, small metal chains were used to maintain tension between the various corners of the device. In other implementations, elastic bungee strings may be used, although any type of tensioning device may be used in place thereof. Elasticity is not a requisite property of the tension devices.

Referring to side 29 in FIG. 1, a back section 44 of top part 22 is connected to a diagonally-opposite front section 45 of bottom part 36 via tension device 46. A front section 47 of top part 22 is connected to a diagonally-opposite back section 49 of bottom part 36 via tension device 50. A identical configuration is implemented for side 28 (see FIG. 8). The resulting tension causes device 10 to maintain its shape. In this implementation, the tension devices can be detached, thereby allowing the device to be folded. Folding promotes portability and also makes device 10 easier to store.

In one example, "foldable" means that frame 11 has plural parts that are movable relative to one another in order to collapse the frame and thereby reduce the volume encompassed by the frame. As shown in FIG. 8, the top part 22 of frame 11 is removably attached to the back part 30 of the frame. The attachment may be via pins (e.g. wooden dowels or one or more types of metal pins), hinges, bolts, or by whatever mechanism or mechanisms permits top part 22 to detach from back part 30 and to rotate around front part 14. In FIG. 8, the attachment is via pins, such as pin 52 on side 28 and a counterpart pin on side 29 (not shown). The part 22 is rotatably mounted to front part 14 at point 54; bottom part 36 is rotatably mounted to front part 14 at point 55; and bottom part 36 is rotatably mounted to back part 30 at point 56. As above, mounting may be implemented via pins, hinges, bolts, or by whatever mechanism or mechanisms support movability of the parts relative to one another at the points of mounting.

Figure 9:
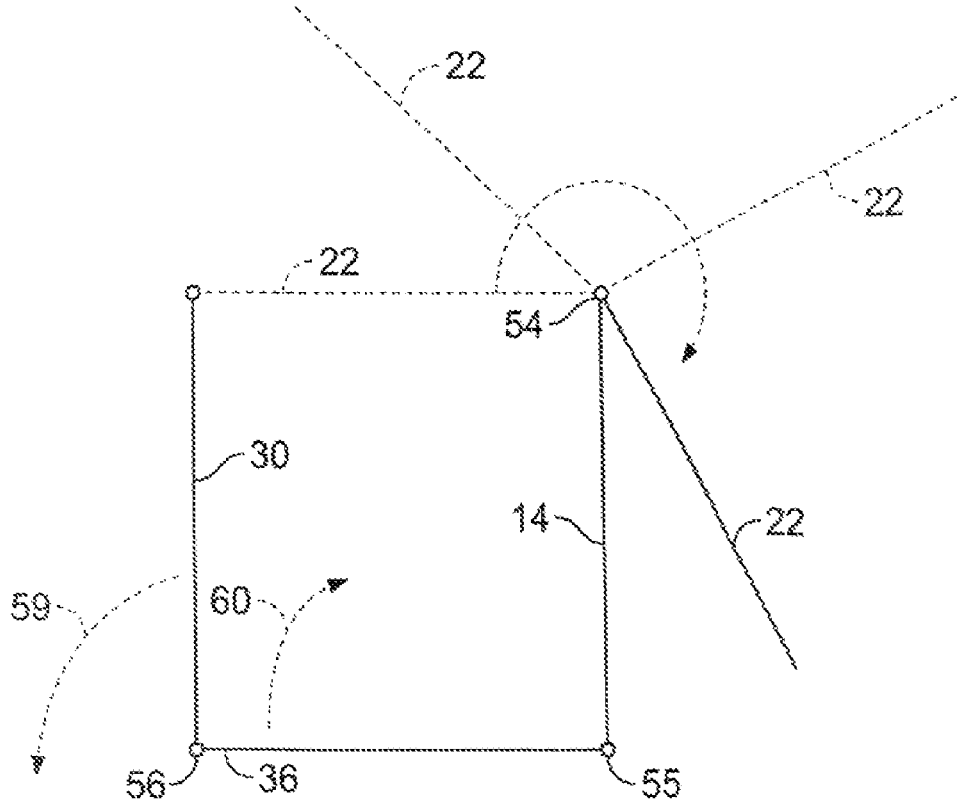
FIGS. 9 and 10 are side views of the paintball targeting system which show how the paintball targeting system collapses/folds upon itself.
Figure 10:
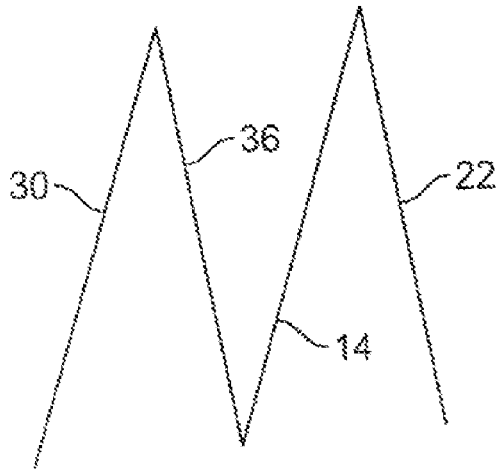
Figure 11:
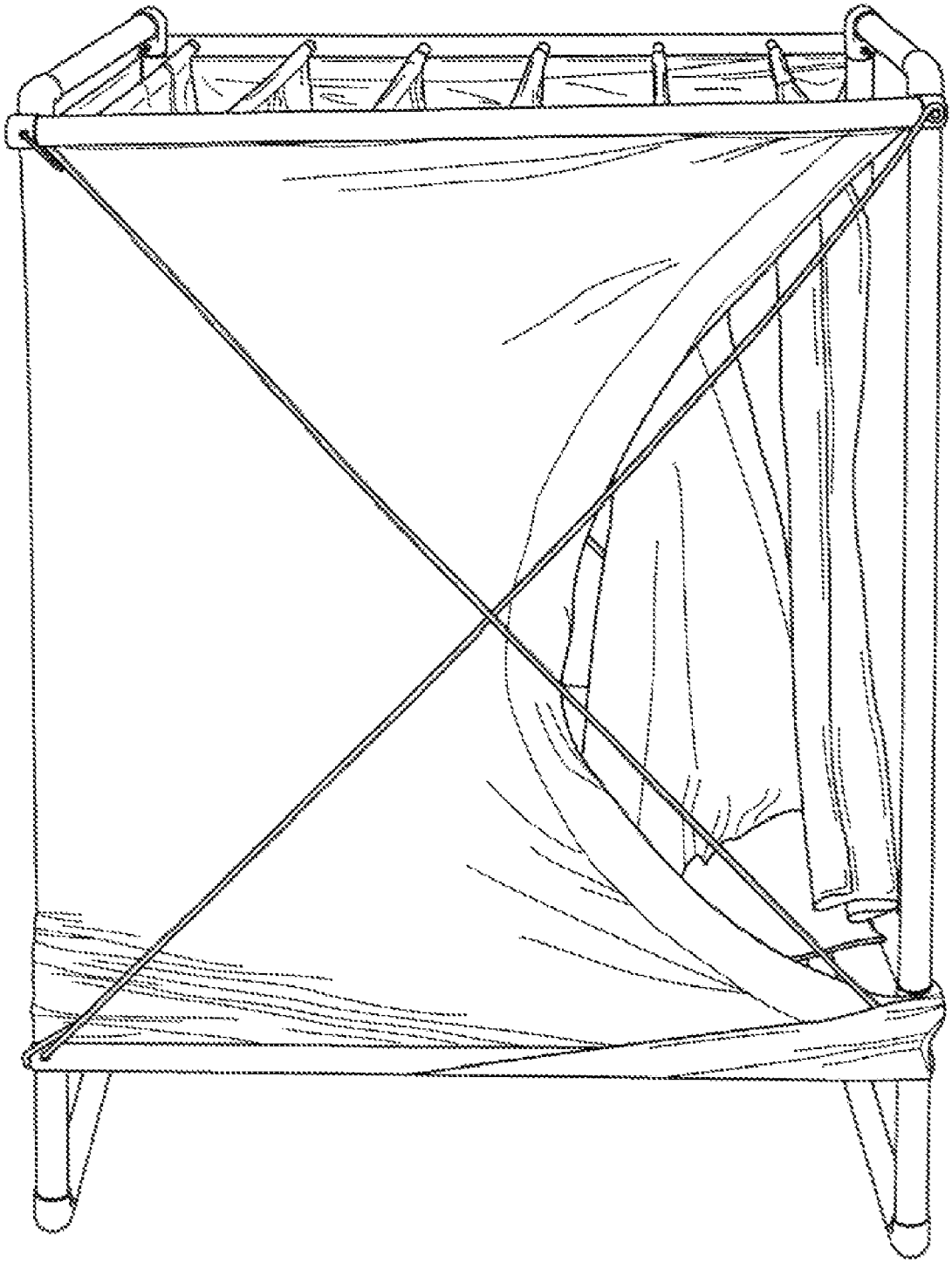
FIG. 11 is a side perspective view of the paintball targeting system.

To fold device 10, the tension devices are detached, at least partly, front frame 11. In this example, the tension devices are detached from bottom part 36; however, the invention is not limited as such. The material comprising sidewalls 40 and 41 and backwall 42 may also need to be detached at predetermined points from device 10. Also, pin 52 and its counterpart on side 29 are removed, thereby detaching top part 22 from back part 30. Top part 22, therefore, is permitted to rotate about point 54 and, as shown in FIGS. 9 and 10, may be brought over, and in front of, front part 14. Back part 30 rotates at point 56 and bottom part 36 rotates at point 55. Thus, as shown in FIGS. 9 and 10, back part 30 may be brought down (arrow 59 in FIG. 9) and bottom part 36 may be brought up (arrow 60 in FIG. 9), causing device 10 to collapse in the manner shown in FIG. 10. The speedloader may, or may not, need to be detached from device 10.

FIGS. 2 and 5 show representative dimensions of device 10 in inches, i.e., 50 inches height, 40 inches width, 38 inches depth, and 38 inches between structure 32 (e.g., a tray) and top part 22. It is noted that device 10 may be produced according to any dimension.

Test results have shown that device 10 promotes reusability of paintballs, thereby allowing a player to target practice using actual paintballs at a relatively low cost. A cost analysis is provided below, which evidences cost savings associated with device 10.

More specifically, in one example, through repetitive testing, is was determined that one standard paintball could be recycled through a version of device 10 78 times. This paintball, recycled 78 times, would effectively cost approximately \$0.03. The approximate cost is determined by determined based on the \$15 cost of 500 paintballs. Multiplying the number of repetitions by the amount an individual paintball costs yields: 78×\$0.03=\$2.34. Thus, each paintball, retailing at \$0.03, would have an equivalent value of \$2.34. Since each paintball has an equivalent value of \$2.34, and since an average bag of paintballs includes 500 paintballs, it can be determined, using multiplication that an average bag of 500 paintballs purchased for $15 would have an equivalent value of $1,170 using device 10. In other words, a player wasting one paintball per practice shot would have to spend $1,170 on paintballs, whereas a player reusing paintballs via device 10 would only need to spend $15 to make the same number of practice shots.

It was also determined, through experimentation, that paintballs used with device 10 retain their structure relatively well over time. Thus, a small investment can reap significant gains. In one example, the number of paintballs used in a test was 30; therefore, the cost of those paintballs is effectively $0.90 (i.e., 30×$0.03). Using 1,085 times as a reference, it was determined that each paintball was shot through the device 10 an average of 36.2 times, i.e., 1,085/30=approximately 36.2. Establishing an average lifespan allows for the calculation of the amount of times a standard bag of 500 paintballs could be shot through device 10, namely 500×36.2=18,083.

Figure 12:
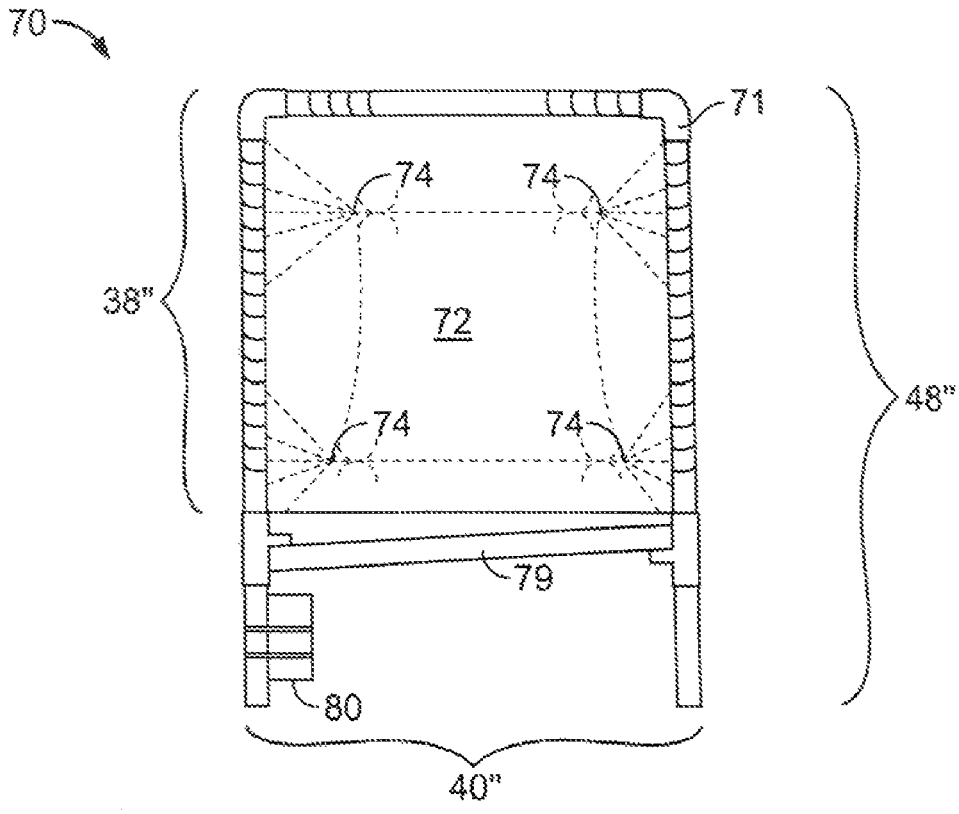
FIG. 12 is a front view of alternative implementation of a paintball targeting system.
Figure 13:
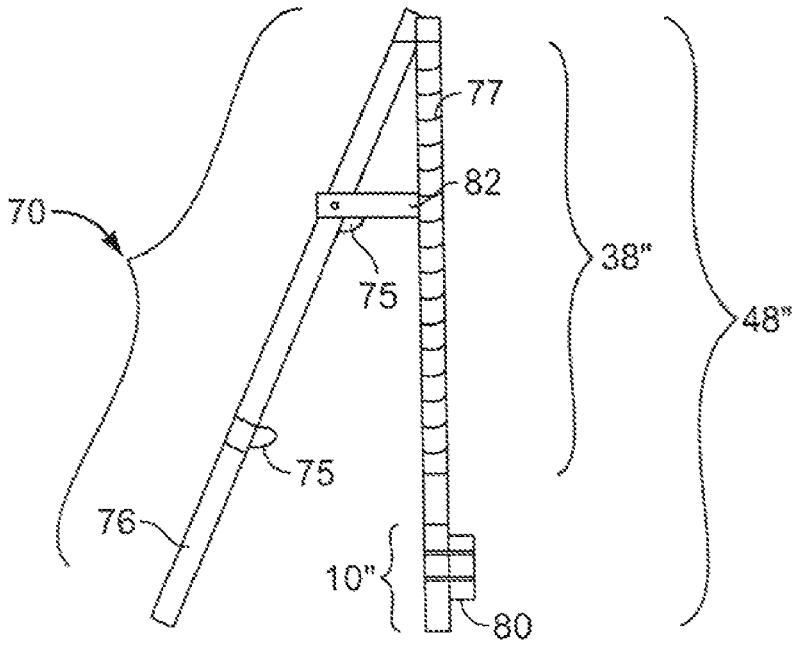
FIG. 13 is a side view of the paintball targeting system of FIG. 12.

The invention is not limited to the paintball targeting system described above. For example, in another implementation, shown in FIG. 12, a device 70 includes a frame 71 and material 72. Frame 71 may be constructed from a relatively study material, such as PVC (polyvinyl chloride) or other type of plastic, metal, or the like. As above, material 72 may be a relatively light mesh-like cloth, plastic, or other perforated or non-perforated material, and may be padded. Material 72 may be mounted to include various pinch points 74, which may be implemented by attaching the material to the frame at those points and by connecting adjacent pinch points via sturdy (e.g., plastic, metal, wood, etc.) strips. The attachment may be via tension devices 75 (e.g., elastic bungee strings) that are connected to both the material and a back part 76 of frame 71, which is shown in FIG. 13.

In this regard, as noted, frame 71 contains a back part 76 that is angular and that supports a front part 77. A target (not shown in FIGS. 12 and 13), which may be similar to the targets described elsewhere herein, may be mounted to the front part. Mounting may be effected in any manner described herein. Frame 71 may also include a structure 79, such as a tray, for directing paintballs received via material 72 to a speedloader 80. Speedloader 80 may be mounted to frame 71 in the manner described above. Structure 79 may be similar to, or identical to, structure 32 described above. A pivoting brace 82 may connect front part 77 to back part 76, thereby supporting the frame. The pivot may allow the frame to fold.

In operation, a player fires a paintball at a target mounted to front part 77. The paintball passes through the target, and into material 72. The material may be of a type that is sufficient, by itself, to absorb 153 pounds of force from the paintball without breaking the paintball. Once the paintball reaches the material, the paintball falls into structure 79, which is shaped to direct the paintball into speedloader 80.

Elements of devices 10 and 70 may be combined. For example, multiple layers of fabric (as in device 70) may be incorporated into device 70. These layers may be used to reduce the likelihood of damage to the paintball, as described above.

Elements of different embodiments described herein may be combined to from other embodiments not specifically set forth above. Other embodiments not specifically described herein are also within the scope of the following claims.

What is claimed is:

1. A method comprising:

receiving a paintball in a first layer of material, the paintball being received via a target mounted in front of the first layer of material relative to forward motion of the paintball;

slowing forward motion of the paintball via the first layer of material without breaking the paintball;

receiving the paintball in a second layer of material, the second layer of material being behind the first layer of material relative to forward motion of the paintball;

slowing forward motion of the paintball via the second layer of material without breaking the paintball; and directing the paintball to a paintball loader;

wherein the method is performed using a targeting system comprising a frame that holds the first and second layers of material;

wherein the frame comprises a top part, a bottom part, a front part, and a back part, each of the top part and the bottom part being rotatably attached to at least one of the front part and the back part, each of the front part and the back part comprising a structure that encloses an area; and wherein the method further comprises folding the frame by rotating the top part and at least two of: the front part, the back part, and the bottom part, relative to each other to form a folded frame structure in which each of the top part, the bottom part, the front part, and the back part remain connected.

2. The method of claim 1, wherein the first and second layers of material are capable of absorbing at least 153 pounds from the paintball without breaking the paintball.

3. The method of claim 1, wherein, prior to directing the paintball, the method further comprises:

receiving the paintball in a third layer of material, the third layer of material being behind the second layer of material relative to forward motion of the paintball; and slowing forward motion of the paintball via the third layer of material without breaking the paintball.

4. The method of claim 1, wherein, prior to directing the paintball, the method further comprises:

receiving the paintball in N (N>2) layers of material, each of the N layers of material being behind the second layer of material relative to forward motion of the paintball; and slowing forward motion of the paintball via the N layers of material without breaking the paintball.

5. The method of claim 4, wherein N=3.

6. The method of claim 1, wherein the first and second layers of material hang between the top part and the bottom part, and wherein bottom edges of the first and second layers of material are at a substantially same distance from the bottom part.

7. The method of claim 1, wherein at least one of the first and second layers of material comprises strips of material.

8. The method of claim 1, wherein the first and second layers of material both comprise strips of material.

9. The method of claim 1, further comprising:

slowing forward motion of the paintball via one or more layers between the first layer of material and the second layer of material.

10. The method of claim 1, wherein directing the paintball comprises funneling the paintball to the paintball loader.

11. A method comprising:

receiving a paintball via a target; and absorbing force of impact of the paintball by passing the paintball through multiple layers of material without breaking the paintball;

wherein the method is performed using a targeting system comprising a frame that holds the multiple layers of material;

wherein the frame comprises a top part, a bottom part, a front part, and a back part, each of the top part and the bottom part being rotatably attached to at least one of the front part and the back part, each of the front part and the back part comprising a structure that encloses an area; and wherein the method further comprises folding the frame by rotating the top part and at least two of: the front part, the back part, and the bottom part, relative to each other to form a folded frame structure in which each of the top part, the bottom part, the front part, and the back part remain connected.

12. The method of claim 11, wherein the multiple layers of material are capable of absorbing at least 153 pounds from the paintball without breaking the paintball.

13. The method of claim 11, wherein the multiple layers of material slow forward motion of the paintball while allowing downward motion caused by gravity.

14. The method of claim 11, wherein absorbing comprises:

receiving the paintball in N (N>2) layers of material, the N layers of material being arranged one behind another relative to forward motion of the paintball; and slowing forward motion of the paintball via the N layers of material.

15. The method of claim 14, wherein N=5.

16. The method of claim 11, wherein the multiple layers of material hang between the top part and the bottom part, and wherein bottom edges of each of the multiple layers of material are at a substantially same distance from the bottom part.

17. The method of claim 11, wherein at least one of the multiple layers of material comprises strips of material.

18. The method of claim 11, wherein each of the multiple layers of material comprise strips of material.

19. The method of claim 11, further comprising:

directing the paintball to a predefined location following absorbing the force of impact.

20. The method of claim 19, wherein directing the paintball comprises funneling the paintball to the paintball loader.

* * * * *